US005927835A

United States Patent [19]

Mergold et al.

[11] Patent Number: 5,927,835

[45] Date of Patent: Jul. 27, 1999

[54] ARTICLE OF FURNITURE

[76] Inventors: Yuriy Mergold, 8002 21-st Ave., #1H, Brooklyn, N.Y. 11214; Boris Ravvin; David Ravvin, both of 1013 Ave. J, Brooklyn, N.Y. 11230

[21] Appl. No.: 09/093,900

[22] Filed: Jun. 8, 1998

[51] Int. Cl.[6] ..... A47B 83/00

[52] U.S. Cl. ..... 312/235.3; 312/223.5; 312/223.6; 297/142

[58] Field of Search ..... 312/235.3, 223.6, 312/235.2, 223.2, 223.5; 297/1, 3, 17, 141, 142

[56] References Cited

U.S. PATENT DOCUMENTS

| | | | |
|---|---|---|---|
| 1,182,339 | 5/1916 | Bekesi | 297/142 |
| 2,145,201 | 1/1939 | Raeuber | 297/142 |
| 2,348,573 | 5/1944 | Rogers | 297/142 X |
| 2,547,754 | 4/1951 | Herrick | 312/235.3 X |
| 2,700,582 | 1/1955 | Munsch | 297/142 |
| 3,712,667 | 1/1973 | Weber | 312/235.3 X |
| 3,770,334 | 11/1973 | Weber | 312/235.2 X |
| 4,205,876 | 6/1980 | Cetina | 297/3 X |
| 4,329,002 | 5/1982 | Cowen et al. | 312/223.5 X |
| 4,688,861 | 8/1987 | Culver | 312/223.5 |
| 5,230,552 | 7/1993 | Schipper et al. | 312/223.6 |
| 5,333,928 | 8/1994 | Rollinson | 297/142 |
| 5,489,938 | 2/1996 | Maruyama et al. | 312/223.3 X |
| 5,558,418 | 9/1996 | Lambright et al. | 312/223.3 X |
| 5,743,603 | 4/1998 | Kelley et al. | 312/223.3 X |

FOREIGN PATENT DOCUMENTS

| | | | |
|---|---|---|---|
| 527709 | 4/1954 | Belgium | 297/142 |

*Primary Examiner*—Peter M. Cuomo
*Assistant Examiner*—Hanh V. Tran
*Attorney, Agent, or Firm*—Turi Kateshov

[57] ABSTRACT

An article of furniture has a desk part having an inner space, a chair part pivotally connected to the desk part around a substantially vertical axis between an operative position in which the chair part is spaced from the desk part so that a user can sit on the seat part and do work at the desk part, and an inoperative position in which the chair part is introduced into the interior of the desk part to form a compact and substantially peripherally closed unit.

16 Claims, 7 Drawing Sheets

ARTICLE OF FURNITURE

BACKGROUND OF THE INVENTION

The present invention relates to articles of furniture, preferably for education purposes, such as for example furniture for schools, kindergartens, etc.

Articles of furniture of this type are generally known in the art. Conventional articles of furniture include desks, tables and the like, as well as chairs, seats and other associated furniture elements. While they provide convenient seating for students and the like, they possess some disadvantages, for example they are not compact, they can not be substantially nested with one another, easily moved around, they can not be used for versatile purposes, etc.

It is believed to be advisable to further improve the existing articles of furniture of this type.

SUMMARY OF THE INVENTION

Accordingly, it is an object of present invention to provide an article of furniture which is a further improvement of the existing articles of furniture, in particular for educational purposes.

In keeping with these objects and with others which will become apparent hereinafter, one feature of present invention resides, briefly stated, a desk part having an inner space; a chair part; means for pivotally connected said desk part and said chair part with one another around a substantially vertical axis between an operative position in which said chair part is spaced from said desk part so that a user can sit on said seat part and do work at said desk part, and an inoperative position in which said chair part is introduced into said interior of said desk part to form a compact and substantially peripherally closed unit.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
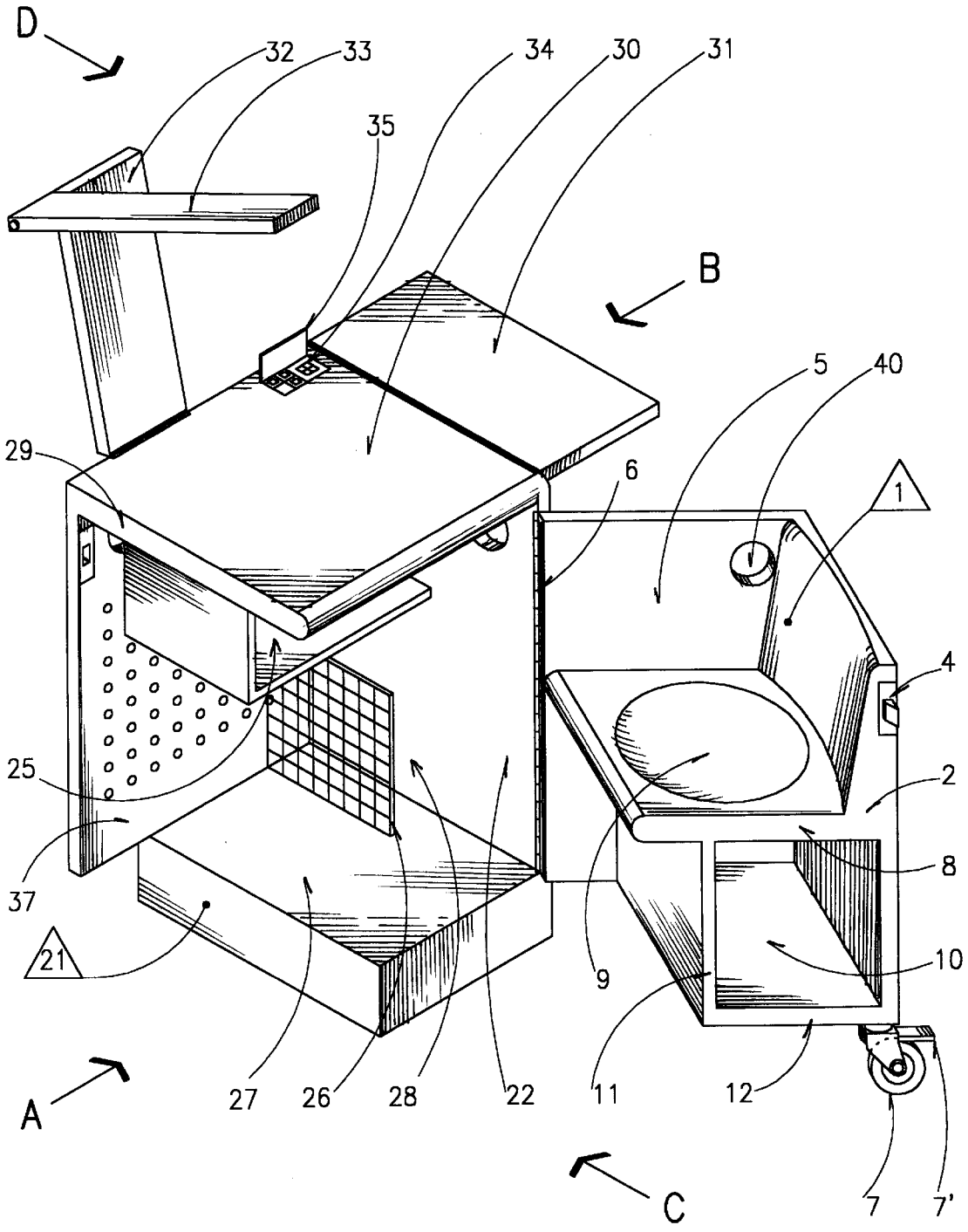
FIG. 1 is a perspective view showing an article of furniture in accordance with the present invention in an extended or operative position.
Figure 1A:
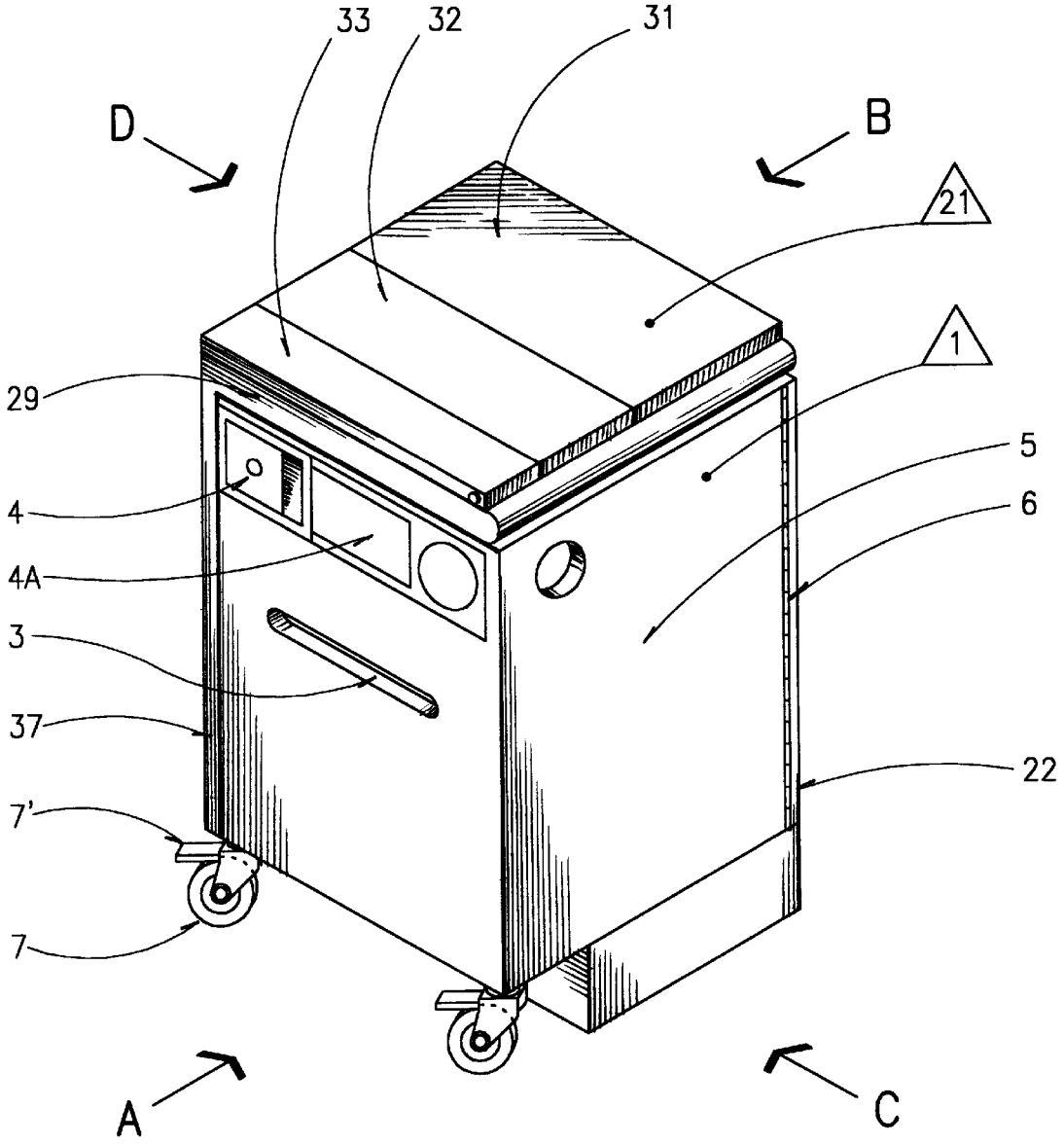
FIG. 1*a* is a view corresponding to the view of FIG. 1 but showing the inventive article of furniture in a closed or inoperative position.
Figure 2:
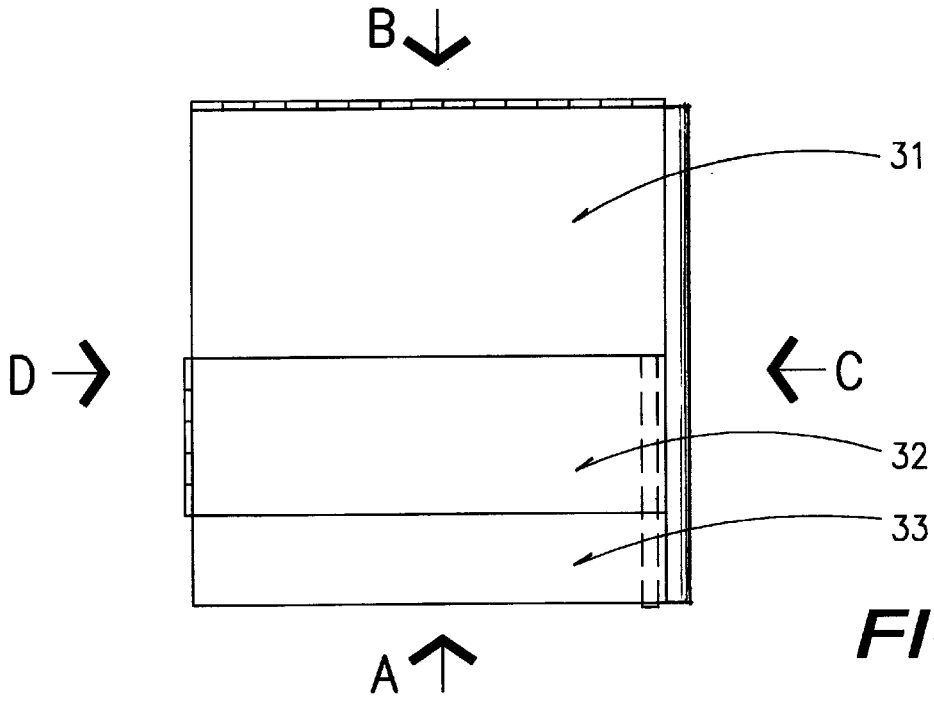
FIG. 2 is a plan view of the inventive article of furniture in an inoperative position.
Figure 3:
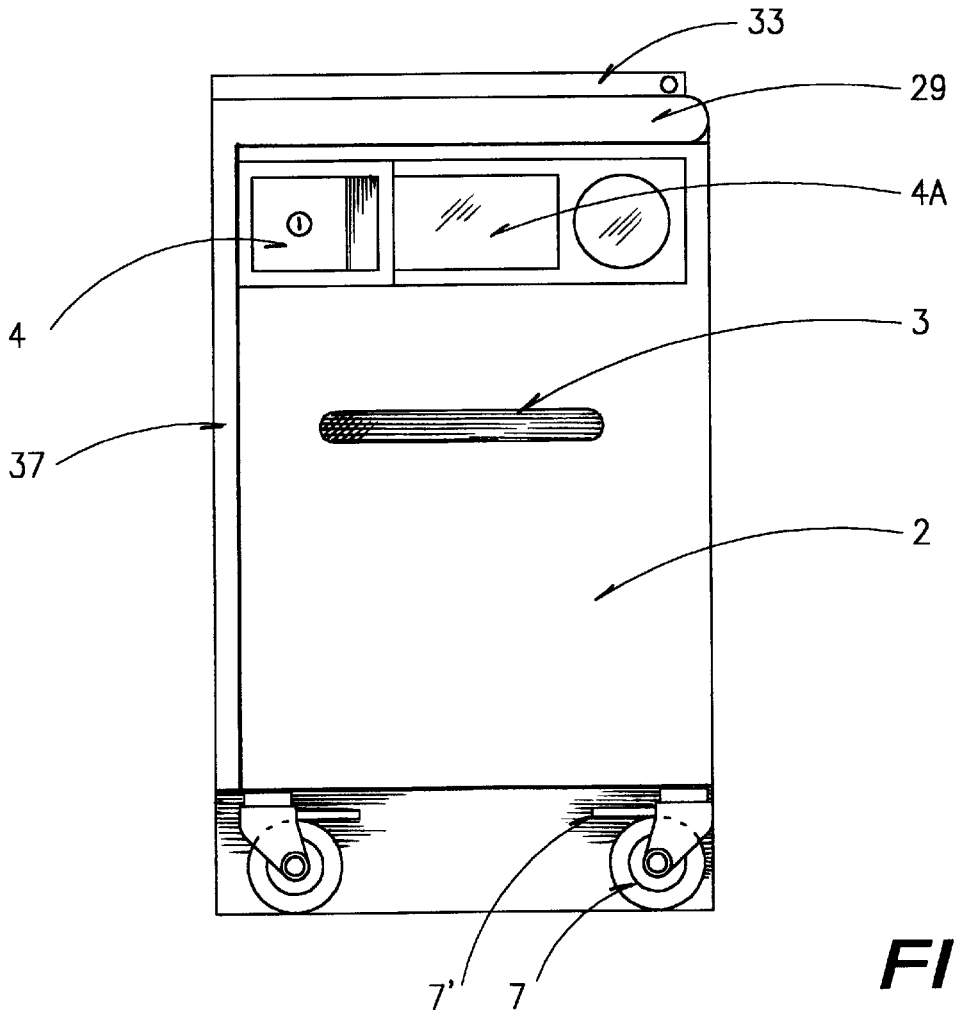
FIG. 3 is a view showing the inventive article of furniture in the inoperative position as seen in direction of the arrow A.
Figure 4:
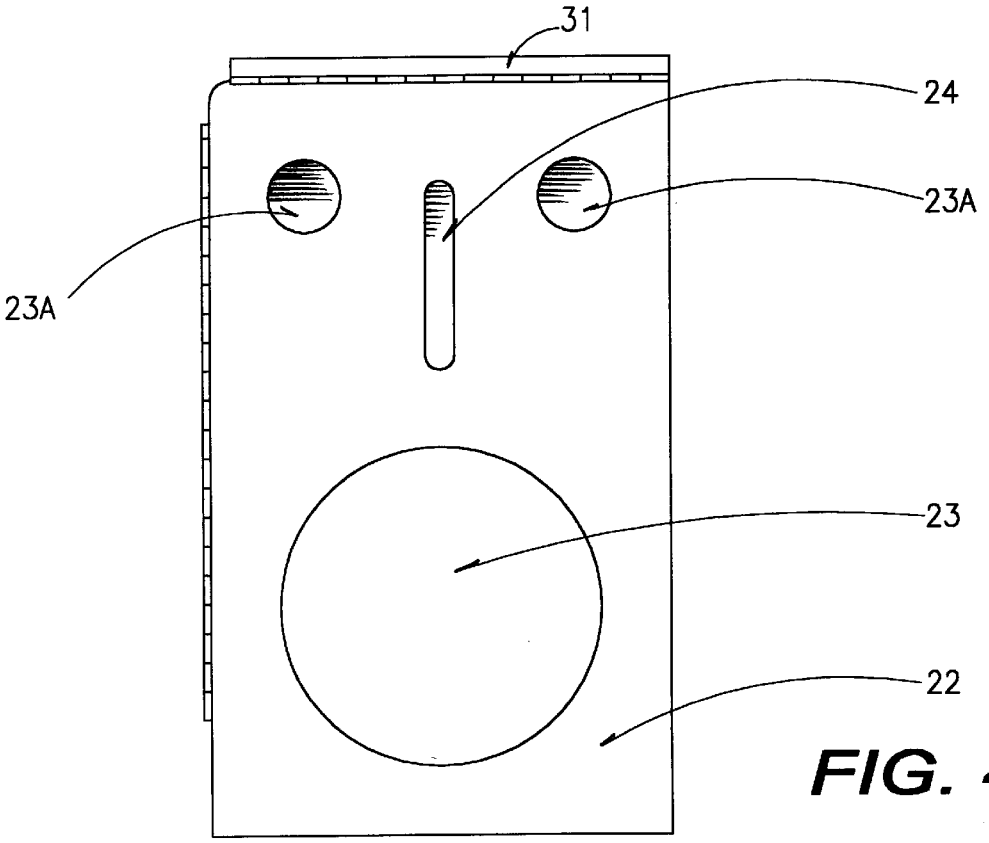
FIG. 4 is a view showing the inventive article of furniture in the inoperative position as seen in direction of the arrow B.
Figure 5:
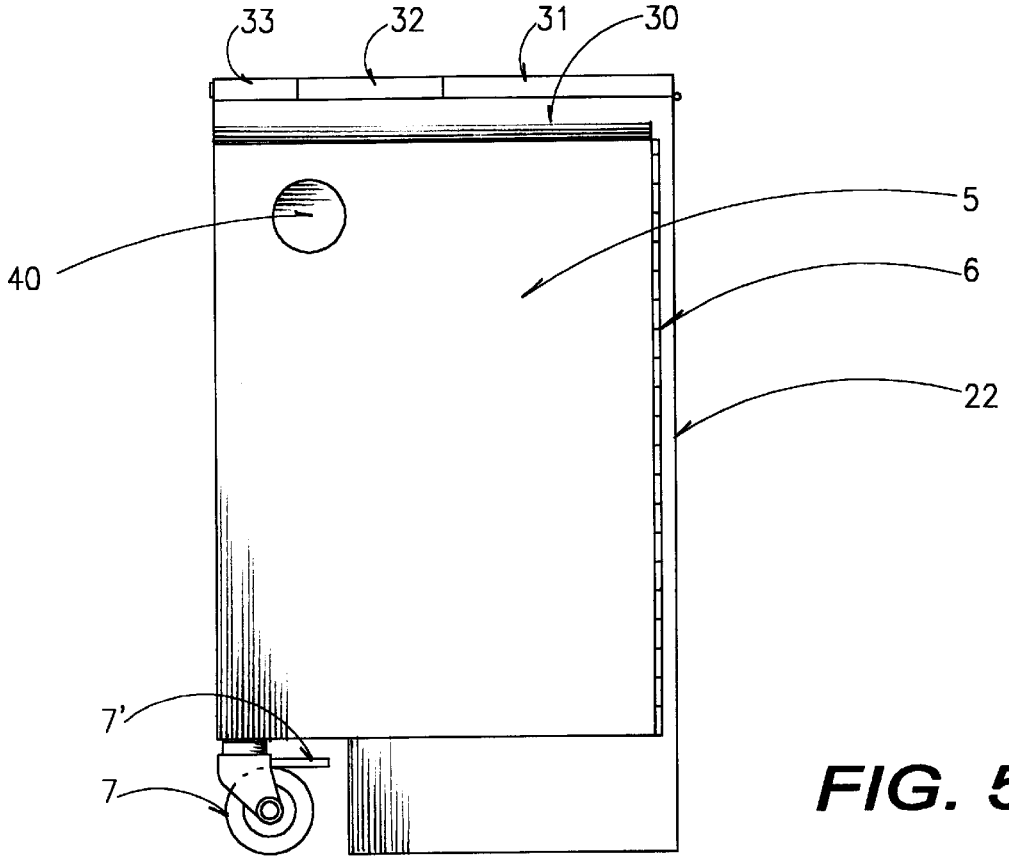
FIG. 5 is a view showing the inventive article of furniture in the inoperative position as seen in direction of the arrow C.
Figure 6:
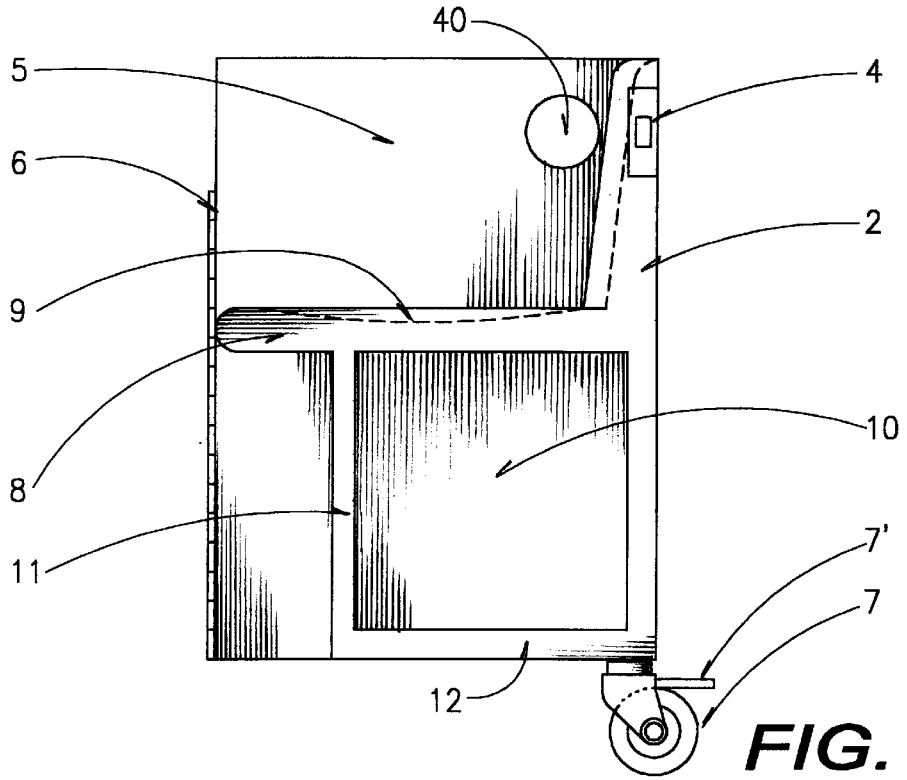
FIG. 6 is a view showing a chair part of the inventive article of furniture as seen in direction of the arrow C.

An article of furniture in accordance with the present invention which is used basically for education purposes, for example for schools, colleges, kindergartens, etc. has a chair part which is identified as a whole with reference numeral 1. The chair part 1 has a substantially vertical wall 2 which is provided with substantially horizontal slot 3 for introducing some papers, for example by a teacher, into the interior of the article of furniture. The wall 2 also has a display window 4*a* in which an identification tag is inserted for example with a student's name and class number. Finally, a latch with a lock 4 is mounted in the wall 2 for locking/opening the chair part 1 with a desk part which will be described in detail later on. The lock latch 4 has a key hole as shown in the drawings. The chair part 1 has another vertical wall 5 which extends substantially perpendicular to the wall 2. One part of a hinge 6 having a substantially vertical axis is mounted on the edge of the wall 5. Another part of the hinge 6 is mounted on a wall of the desk part which will be explained in detail later on. At least two rollers 7 are mounted on the bottom portion of the chair part 2, for example through casters and the like. The rollers 7 does not project downwardly beyond a lower surface of the desk part so as not to affect stability of the article of furniture. The rollers have brakes 7' to hold chair part in any desirable position.

The chair part 1 further has a substantially horizontal panel 8 which forms a seat. The upper surface of the panel 8 can be provided with a depression g to ensure an ergonomically convenient seating of a person. The panel 8 forms an upper limit of a compartment 10 which, from the other sides is limited by the wall 2 as well as a side wall 11 and a bottom wall 12. The compartment 10 has an opening which is shown in the drawings. Various objects can be introduced in the compartment 10. For example student backpack.

Figure 7:
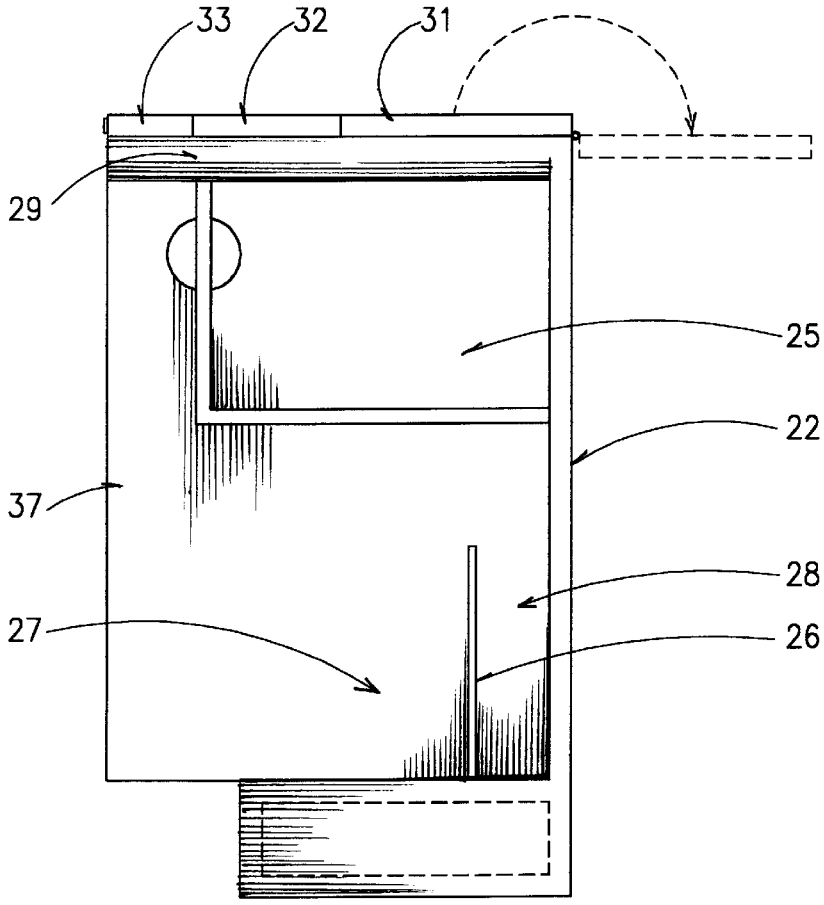
FIG. 7 is a view showing a desk part of the inventive article of furniture as seen in direction of the arrow C.

The desk part of the inventive article of furniture is identified as a whole with reference numeral 21. It has a vertical wall 22 which on its vertical edge is provided with the other part of the hinge 6 which is connected with the first part of the hinge mounted on the wall 5 of the chair part 1 so as to pivot relative to one another around a substantially vertical axis. Such hinges are known in the art and include interengaging parts and a vertical pin extending introducing them. The wall 22 is provided with a depression 23. When the article of furniture is turned to be placed in the inoperative position on an opposite wall of the desk part, the depression 23 forms a seat so that a person can sit on the wall 22 which is located in this situation in a horizontal position. The wall 22 also has openings 23A through which arm can be inserted for handling the article of furniture as well as a substantially vertical slot 24 for through some papers into the interior of the article of furniture, as well as for reducing the weight of the article of furniture. As can be seen from FIG. 7, the wall 22 together with a vertical wall part and a horizontal wall part forms a compartment 25 in which some objects can be introduced by a user. A wall part 26 subdivides an interior of the desk part 21 into two compartments 27 and 28 spaced from one another in a horizontal direction. Also, corresponding objects can be stored in the compartment 28.

The desk part 21 further has a horizontal panel 29 which on the one hand limits the compartment 25 from above, and on the other hand has an upper surface 30 for placing objects on it, such as notebooks, books, papers, etc during the use of the article of furniture. The upper surface 30 of the panel 29 can be extended by a turnable flap 31 which is turnably connected with the panel 29 by a horizontal hinge. The flap 31 is movable between an inoperative position shown in FIG. 7 in which it is placed on top of the surface 30, and an operative position in which it extends horizontally as a continuation of the upper surface 30 of the panel 29 shown in FIG. 1. Another flap 32 is turnably connected with the panel 29 also for example by a flexible film hinge. The flap 32 is turnable between a substantially vertical or slightly inclined position in which it serves to support paper, notebooks, etc. in such a position, and an inoperative position shown in FIG. 7 in which it is placed on top of the surface 30. A light element 33 can be turnably connected with the flap 32 for example also by a pin hinge. In the operative position shown in FIG. 1, the light member 33 is located substantially above the panel 29 so as to emit light toward the upper surface 30, while in the inoperative position shown in FIG. 7 it is placed on top of the upper surface 30.

Figure 8:
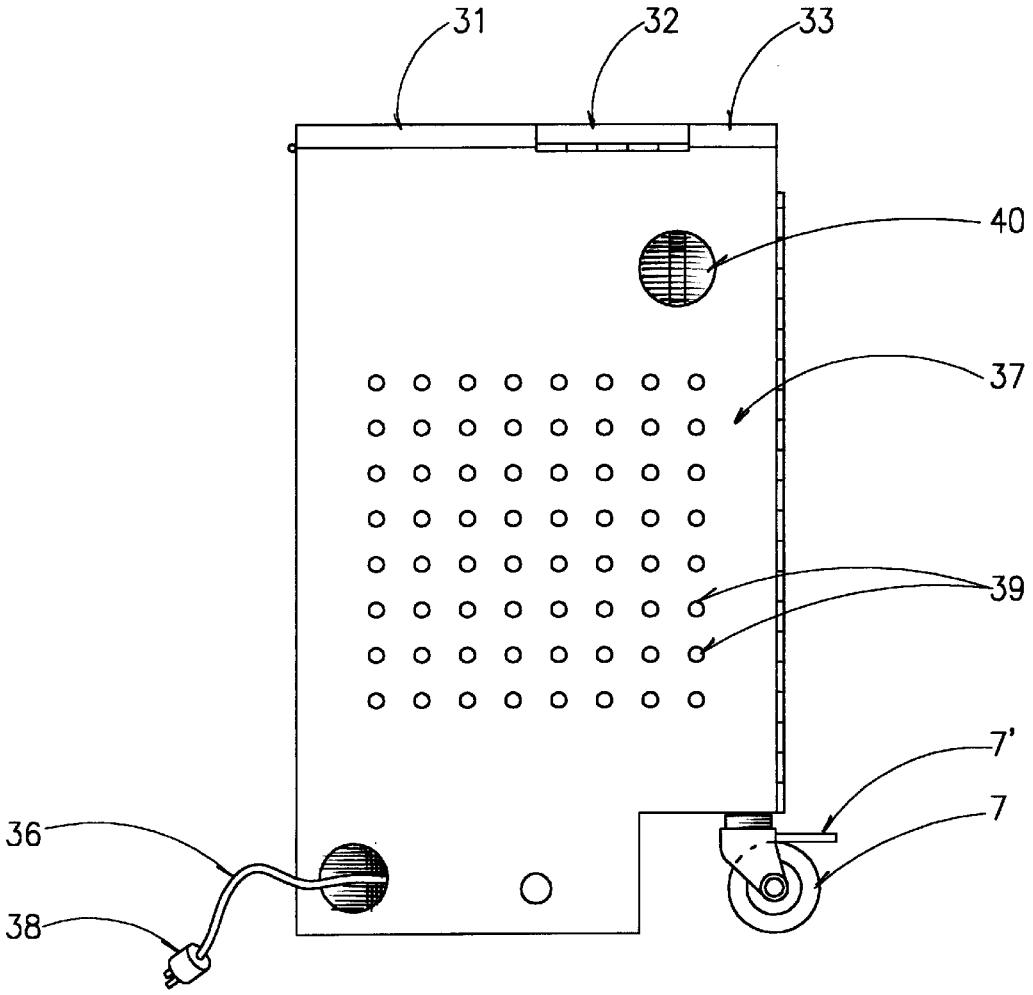
FIG. 8 is a view showing the inventive article of furniture in the inoperative position as seen in direction of the arrow D.

The upper panel 29 is provided with electrical outlets 34 which are covered by a turnable safety cover 35. In an operative position, the safety cover 35 is turned open to expose the electrical outlets 34 so that electrical devices, such as for example a computer placed on the surface 30 can be plugged into the outlets 34. An electrical retractable cord 36 shown in FIG. 8 extends from the outlets 34 through a pipe chase inside the desk part 21 and ends in a plug 38 which can be plugged into an electrical/computer network outlet provided in a floor or in a wall of a room of an educational institution. The wall 37 is provided with a plurality of openings 39 for ventilation and for reducing the weight of the article of furniture, as well as with an opening 40 in which a user's arm can be inserted for handling the article of furniture.

The article of furniture in accordance with the present invention operates in the following manner:

In the operative position shown in FIG. 1, the chair part 1 is pivoted around the horizontal axis to be positioned besides the desk part 21. And fixed in position by the brakes. A user can sit on the chair part 1 and do work on the desk part 21. Electrical devices, such as for example a notebook computer can be installed on the panel 29 of the desk 21, and the light 33 can illuminate the corresponding area. The papers and other information carriers can be supported on the flap 32, while the flap 31 extends horizontally and other objects can be placed on it. Top of the wall 5 is used as elbow support. The corresponding objects of a student can be inserted into the compartments 10, 25, 28. After the period of use of the article of furniture, the user pivots the chair part 1 and introduces its portions 8, 11, 12 into the interior of the desk part 21 so as to prevent relocation of the object accommodated in the interior of the chair part and desk part. The vertical walls 22, 37, 2 and 5 form closed four sides of the article of furniture which assumes a parallelepiped shape. The pivoting of the chair part 1 relative to the desk part 21 is facilitated by the rollers 7. When it is necessary to move the thusly closed article of furniture to another location, a user grasps the article of furniture by introducing its arms into corresponding openings, inclines the article of furniture so that it rests on the wheels 7 and rolls the article of furniture to a corresponding location.

Figure 9:
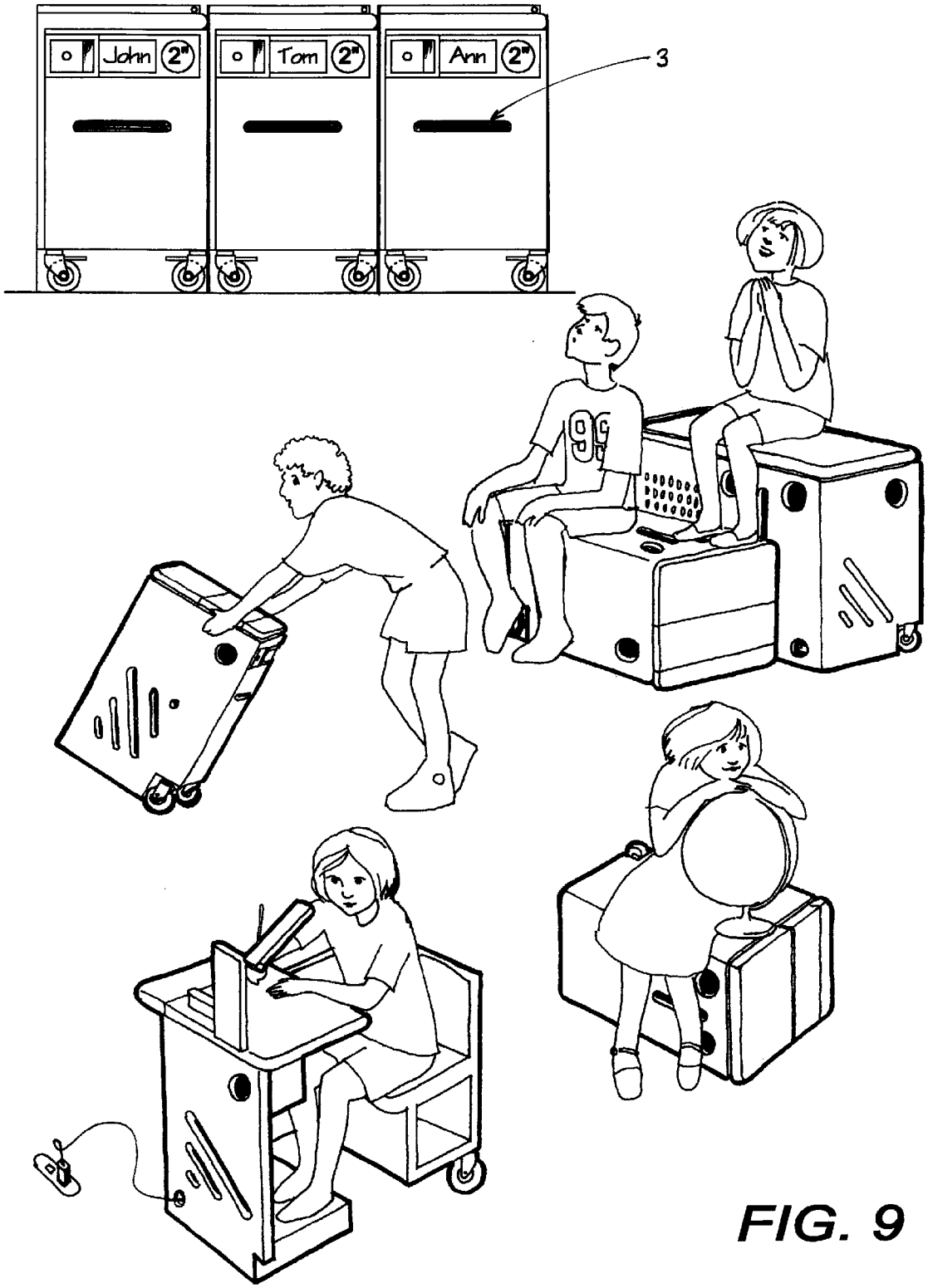
FIG. 9 is a view showing a possible use of the inventive article.

As can be seen from FIG. 9, the article can be turned sideways so as to serve as a seating article. The fact that the inventive article can be placed in a vertical position so that a student is able to sit on the chair part near the desk part, can be placed in a horizontal position so that the student is able to sit on top of it, and can be easily moved to any location provides for a variety of classroom layouts and a significant flexiblity of teaching process.

It will be understood that each of the elements described above, or two or more together, may also find a useful application in other types of constructions differing from the types described above.

While the invention has been illustrated and described as embodied in article of furniture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An article of furniture, comprising:

a desk part having an inner space delimited by a front wall and a desk side wall;

a chair part formed with a chair side wall and a chair back wall extending substantially perpendicular to each other;

pivoting means for pivotally connecting said chair and desk side walls to displace said desk part and said chair part around a substantially vertical axis between an operative position in which said chair part is spaced from said desk part so that a user can sit on said seat part, and an inoperative position in which said chair part is introduced into said interior of said desk part to form a compact and substantially peripherally closed unit; and at least one wheel operatively connected with one of said chair and desk parts and rotatable about a wheel axis extending perpendicular to said vertical axis, said one wheel being spaced from said chair side wall and cooperating with the pivoting means to controllably displace said desk and chair parts between said operative and inoperative positions, said article being tiltable about the wheel axis in said inoperative position for multidirectional displacement of the article on said one wheel.

2. An article as defined in claim 1, wherein, said means for pivotally connected said chair part with said desk part include a hinge connecting said chair and desk side walls of said chair part and desk part with one another to pivot around the substantially vertical axis.

3. An article as defined in claim 1, wherein said seat part has a substantially horizontal seat member and a compartment located under said seat member and having an opening for inserting an object, said chair side wall being parallel to said front wall of the desk part and said back wall of said chair part being parallel to said desk side wall in said inoperative position.

4. An article as defined in claim 1, wherein said desk part has a substantially horizontal upper object supporting panel, and at least one side flap turnably connected with said panel for turning between an inoperative position in which it is coextensive with said panel and an operative position in which it extends substantially side-by-side with said panel to increase an area of said panel.

5. An article as defined in claim 4; and further comprising a second flap turnably connected with another side of said panel and movable between substantially vertical position to support an object and a horizontal position in which it is coextensive with said panel.

6. An article as defined in claim 5; and further comprising a turnable light connected with said second flap and turnable between an inoperative position in which it is coextensive with said panel and an operative position in which it extends above said panel so as to illuminate an upper surface of said panel.

7. An article as defined in claim 1, wherein said desk part has a substantially horizontal panel with an upper surface for supporting objects; and a compartment located under said panel and having an opening for introducing objects.

8. An article as defined in claim 1, wherein said desk part has substantially vertical partition subdividing the interior of said desk part into at least two compartments spaced from one another in a horizontal position.

9. An article as defined in claim 1, wherein desk part has a substantially vertical wall provided with a depression, so that when the article of furniture turned sideways and placed on a floor, said depression can serve as a seat.

10. An article as defined in claim 1, wherein said back wall wall of said chair part has a plurality of openings facilitating carrying of the article of furniture.

11. An article as defined in claim 1, wherein at least one of said chair part and desk part has a substantially vertical wall with at least one slot for introducing a mail or the like through said slot into the interior of said desk part.

12. An article as defined in claim 1, wherein said desk part has a substantially vertical wall provided with a plurality of openings for facilitating carrying the article of furniture.

13. An article as defined in claim 1 wherein said one wheel is connected to said chair part so as to roll said chair part during turning between said operative and inoperative position, and also to roll the whole article of furniture from one place to another.

14. An article as defined in claim 13, wherein said one wheel provided with brakes for fixing said chair part in a corresponding position.

15. An article as defined in claim 1; and further comprising electrical conductor means extending through said desk part and having an outlet provided on a top portion of said desk part for attaching electrical devices and an inlet provided in a bottom portion of said desk part and connectable with an electrical and computer network outlet.

16. The article defined in claim 1 further including at least one second wheel rotatable about a respective axis and spaced horizontally from the one wheel, said one and second wheels being mounted on a bottom of said chair part and lying in a common horizontal plane extending perpendicular to said chair back and desk side walls and spaced from said front desk wall in said inoperative position.

* * * * *